United States Patent [19]

Lamle

[11] Patent Number: 4,805,915

[45] Date of Patent: Feb. 21, 1989

[54] BOARD GAME WITH CHANGEABLE PLAYING PIECES

[76] Inventor: Stewart M. Lamle, 55 W. 86th St., New York, N.Y. 10024

[21] Appl. No.: 15,132

[22] PCT Filed: May 30, 1986

[86] PCT No.: PCT/US86/01181

§ 371 Date: Feb. 3, 1987

§ 102(e) Date: Feb. 3, 1987

[87] PCT Pub. No.: WO86/07276

PCT Pub. Date: Dec. 18, 1986

Related U.S. Application Data

[63] Continuation-in-part of Ser. No. 740,484, Jun. 3, 1985, abandoned.

[51] Int. Cl.[4] ..... A63F 3/02

[52] U.S. Cl. ..... 273/261; 273/289; 273/291

[58] Field of Search ..... 273/261, 289, 291, 260, 273/239, 271, 282, 290

[56] References Cited

U.S. PATENT DOCUMENTS

| | | | |
|---|---|---|---|
| 937,796 | 10/1909 | Hallock | 273/260 |
| 1,492,071 | 4/1924 | Cornell et al. | 273/260 |
| 3,462,150 | 8/1969 | Eriksson | 273/258 |
| 3,759,523 | 9/1973 | Randolph | 273/291 |
| 3,918,715 | 11/1975 | Puglisi | 273/260 X |
| 4,036,501 | 7/1977 | Hovnanian | 273/260 X |
| 4,343,476 | 8/1982 | Engel et al. | 273/289 |

OTHER PUBLICATIONS

Games, Nov./Dec. 1978, p. 50, 10/1978, "Tooché".

Diagram Group, "The Way to Play", ©1975, 3/1976, pp. 36–37 & 40.

*Primary Examiner*—Paul E. Shapiro

[57] ABSTRACT

A board game apparatus for use in playing a game between two players includes a game board having an alternating pattern of light and dark squares, a first set of game pieces which is light in color, and a second set of game pieces which is dark in color. First keying devices are attached to the light squares of the game board and second keying devices are attached to the dark squares. The first keying devices affect the appearance of the first set of game pieces but not the second set of game pieces, and said second keying devices affect the appearance of the second set of game pieces but not the first set of game pieces. A game piece of one of the sets becomes a game piece of the other set when the piece is turned over.

18 Claims, 3 Drawing Sheets

Fig_1
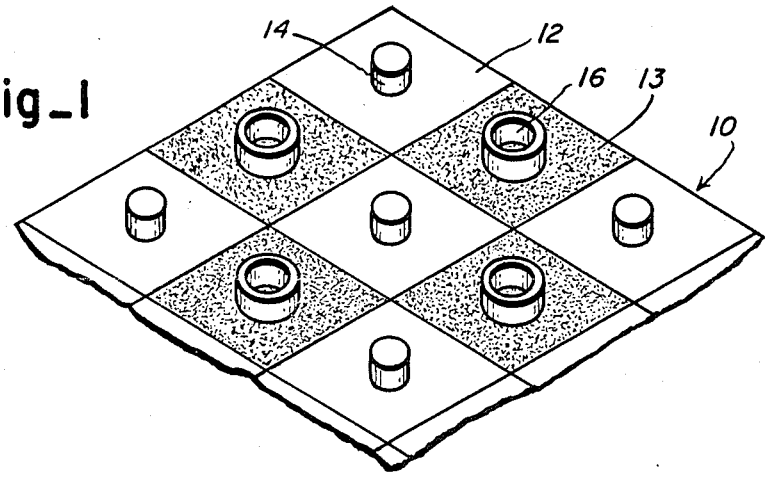
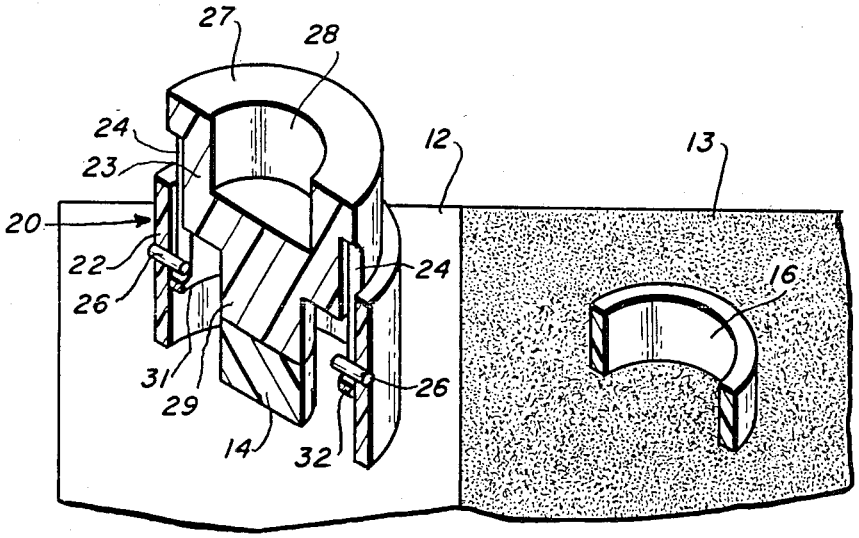
Fig_2

BOARD GAME WITH CHANGEABLE PLAYING PIECES

This case is a continuation-in-part of U.S. Ser. No. 740,484 filed June 3, 1985, now abandoned.

TECHNICAL FIELD

This invention relates to a board game comprising a playing board and board-interactive changeable playing pieces.

BACKGROUND ART

A multitude of checker-type board games are known in the art. Such games normally comprise a checkerboard-type playing surface having alternating light and dark squares. Two players each have a set of playing pieces of a distinctive color which are maneuvered around the board in an attempt to capture or eliminate the other player's playing pieces. While such games often provide fun and challenging game play, they are easily mastered because of the limited number of moves and options which the players may make during the game. Captured or eliminated game pieces of each player reduce the number of pieces remaining on the board, thus simplifying game play even further.

Accordingly, there is a need in the art for a checker-type board game wherein the number of game pieces on the board is not reduced during game play. Such a game could be devised wherein the opponent's pieces become the capturing player's pieces rather than being eliminated from the board. Additionally, the complexity of checkerboard-type games could be increased by providing a means for indicating a change in rank of a game piece upon the fulfillment of certain conditions, wherein differently ranked game pieces would be capable of different moves.

A board game apparatus comprises a checkerboard-type playing surface having light and dark squares thereon. First and second sets of keying means are attached to the light and dark squares respectively. A first set of game pieces has a top surface which is light in color and a bottom surface which is dark in color, and a second set of game pieces has a top surface which is dark in color and a bottom surface which is light in color. The game pieces are movable to both the light and dark squares of the playing board, and the keying means influence the appearance of the game pieces causing them to have a high or a low rank. The rank of the game pieces determines the type of move that the piece may make.

It is therefore an object of the invention to provide a game board apparatus comprising a playing board and two sets of game pieces.

It is another object of the invention to provide a game apparatus comprising a playing board having keying means thereon and first and second sets of game pieces which are responsive to the keying means to change the rank of the game pieces.

These and other objects of the invention will become apparent from the following detailed description in which reference numerals used throughout the description designate like or corresponding parts on the drawing figures.

BRIEF DESCRIPTION OF THE DRAWINGS

FIG. 1 shows a portion of the game board of the instant invention.

FIG. 2 shows a sectional view of a game piece on a portion of the game board.

BEST MODE FOR CARRYING OUT THE INVENTION

Figure 3:
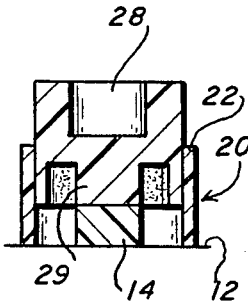
FIGS. 3 and 4 shows one player's game piece in a high rank state and a low rank state.

Turning now to the drawing figures, there is shown in FIG. 1 a partial view of the game board generally designated by the reference numeral 10. The board comprises a plurality of alternating light squares 12 and dark squares 13 arranged in a checkerboard pattern. Each of the light squares 12 has a peg keying means 14 located in the center thereof and each of the dark playing squares 13 has a ring keying means 16 positioned in the center thereof. The plurality of pegs 14 and rings 16 interact with the playing pieces to change the rank of the game pieces enabling various forms of game play as more fully explained below.

Turning now to FIG. 2, there is shown a game piece 20 positioned on a light square 12 of the playing board 10. The game piece 20 comprises an outer shell 22 and an inner telescoping sleeve 23. The telescoping sleeve 23 includes elongated grooves 24 which receive pins 26 mounted in the shell 22 and allow the telescoping sleeve 23 to slide up and down relative to the shell 22. The top of the sleeve comprises a rim 27 which surrounds a well 28. The bottom of the sleeve comprises a post 29 which is surrounded by an annular groove 31. The end of the post 29 is flush with the end 32 of the sleeve.

As shown, the end of the post 29 abuts the top of the peg 14, and the end of the sleeve 23, including the rim 27 and the well 28, are extended from the shell 22. The game piece 20 may be used in this position, or may be turned over so that the end of the sleeve 23 including the post 29 faces up. In order to enable the keying means 14 and 16 to interact with the game pieces 20, certain dimensional relationships of the ring 16, the rim 27, the peg 14, and the post 29 must be maintained. The diameter of the ring 16 is approximately equal to the mean diameter of the rim 27. The well 28 has a larger diameter than the diameter of the peg 14. The diameter of the post 29 is less than the inner diameter oftthe ring 16, and the mean diameter of the groove 31 is approximately equal to the mean diameter of the ring 16. In order to facilitate identification of the game pieces by the players, the end of the telescoping sleeve having the rim 27 may be colored light, and the end of the telescoping sleeve having the post 29 may be colored dark.

FIGS. 3 to 6 show the game piece 20 in various positions on the light and dark squares 12 and 13. As shown in FIG. 3, a game piece 20 on a light square 12 with the light end facing up causes the post 29 to abut the peg 14 and extend the telescoping sleeve 23 out of the shell 22. Thus, the game piece 20 assumes a high rank.

Figure 4:
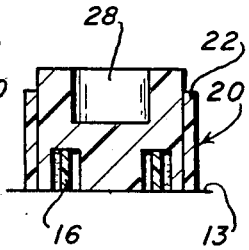

As shown in FIG. 4, with the game piece 20 on a dark square 13, the ring 16 fits into the groove 31 causing the sleeve 23 to be retracted into the shell 22 and giving the game piece a low rank.

Figure 5:
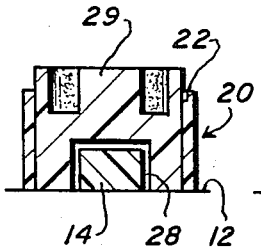
FIGS. 5 and 6 show the other player's game piece in a low rank state and a high rank state.

As shown in FIG. 5, the game piece 20 is positioned on a light square 12 with the dark end up, the peg 14 fits into the well 28 causing the piece to have a low rank.

Figure 6:
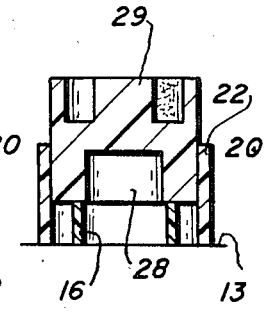

As shown in FIG. 6, when the game piece 20 having the dark end up is positioned on a dark square 13, the rim 27 abuts the ring 16 to extend the telescoping sleeve 23 from the shell 22 causing the piece to have a high rank.

MODE OF USE OF THE BEST MODE

Figure 8:
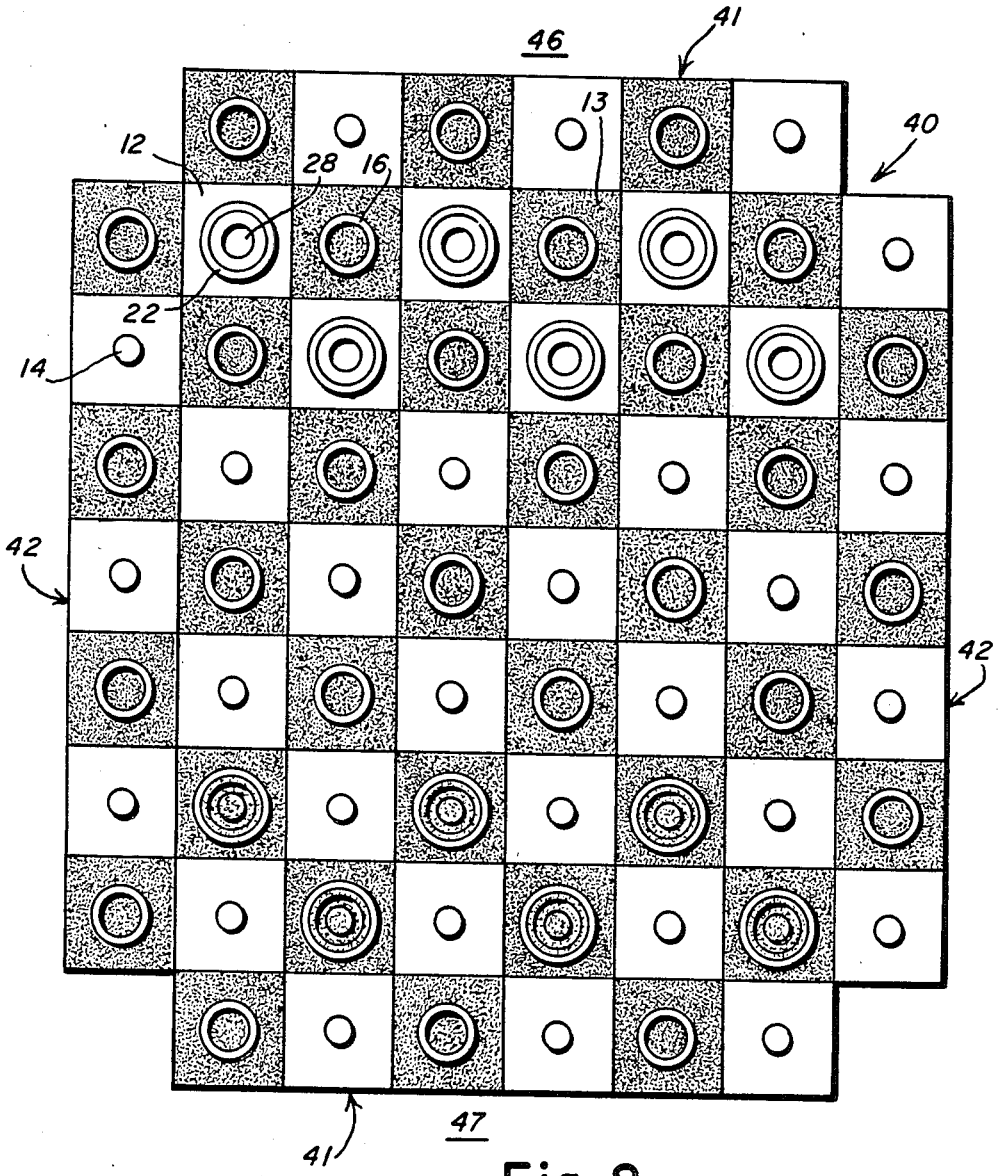
FIG. 8 shows the preferred embodiment of the game board at the beginning of game play.

FIG. 8 shows one form of playing board 40 which may be advantageously used with the instant invention. The board 40 comprises a rectangular center portion of forty-two alternating light and dark squares arranged in a 6×7 pattern which is bordered by end bounce zones 41 and side bounce zones 42. The bounce zones 41 and 42 each comprise a row of alternating light and dark squares; the end bounce zones 41 are 6 squares long, and the side bounce zones 42 are 7 squares long. A first player sits at end 46 of the board, and a second player sits at end 47 of the board. As shown, each player has six game pieces, and the first places his pieces on the six light squares at the end 46 of the rectangular center portion of the board so that the light end of the game piece is up. This causes each of his pieces to have a high rank. The second player places his pieces on the six dark squares at the end 47 of the rectangular center portion of the playing board with the dark end up, causing each of his game pieces to have a high rank.

The players alternate turns by moving one of their pieces in any direction to an adjacent unoccupied square. A piece may also be moved to jump over an adjacent occupied square in any direction if the next square in the same direction is unoccupied. A jumping move may only be made, however, when the jumping piece is in the high rank. A game piece which is jumped becomes one bf the jumping player's pieces. This is indicated by removing the jumped piece from the board, turning the piece over, and replacing the piece on the same square on the playing board. A jumping move may continue with two or more pieces being jumped in a single move providing the square adjacent the jumped piece in the direction of the jump is unoccupied. In performing such moves, a player may jump both an opponent's game pieces and his own game pieces and the direction of the jump may change with each piece that is jumped. The players alternate turns, jumping the opponent's pieces and converting the opponent's pieces to their own pieces until one player succeeds in turning all of an opponent's pieces into his own pieces.

The bounce zones 41 and 42 can be utilized in a jumping move according to the following rule: a piece may jump from a first square into the bounce zone if in the same move the piece can also jump out of the bounce zone to a second square. Thus, the bounce zone allows a player to increase the number of jumps in a single move providing the rule regarding bounce zone jumps is followed. As with other jumps, a bounce zone jump may only be made when the jumping piece is in the high rank, and the jump is over an adjacent occupied square and the next square in the same direction is unoccupied. It will be understood that because of the rule regarding the bounce zone, the bounce zone squares will always be unoccupied.

Figure 7:
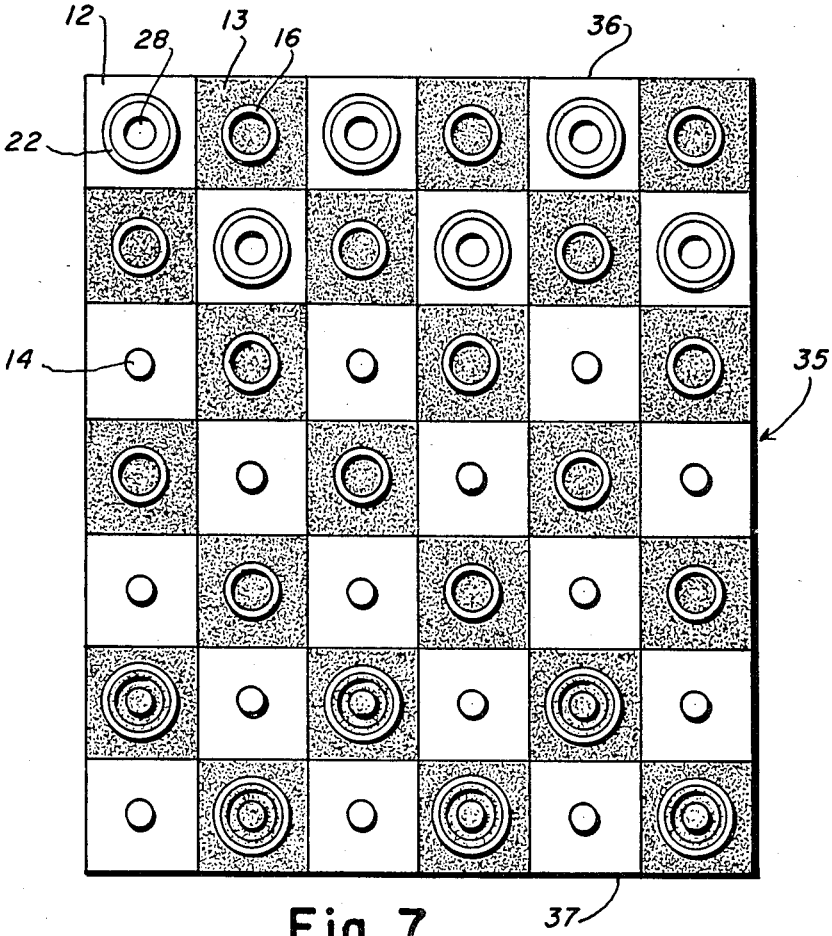
FIG. 7 shows a game board at the beginning of game play.

FIG. 7 shows an alternate form ofthe invention in which a playing board 35 comprises forty-two alternating light and dark squares arranged in a 6×7 pattern. A first player sits at the end 36 of the board and a second player sits at the end 37 of the board. As in the embodiment shown in FIG. 8, each player has six game pieces, and the first player places his pieces on the six light squares at the end 36 of the board so that the light end of the game piece is up. This causes each of his pieces to have a high rank.

The players alternate turns by moving one of their pieces in any direction to an adjacent unoccupied square, and play is governed by the same rules as presented above in conjunction with FIG. 8. Since the FIG. 7 playing board has no bounce zones, there is no bounce zone rule or equivalent bounce zone jump when playing on the playing board 35.

Having thus describe the invention, various alterations and modifications thereof will become apparent to those skilled in the art. For aesthetic purposes, it may be desirable to have a monochromatic color scheme on the board rather than utilizing an alternating light and dark pattern. Such a monochromatic board would be divided into squares by a grid-type line pattern, and the pegs 14 and rings 16 on the board would provide a visual indication of the alternating keying theme of the board which is instrumental in game play. In a like manner, the game pieces may also be all of the same color, with the physical structure of the post 29 and the rim 27 providing the visual indication of the game pieces of the two players.

Other modifications will also be apparent to those skilled in the art. For example, a playing board other than one having forty-two squares may be used; and if larger boards are used, the number of gamepieces used in the game may also increase. Additionally, while a rectangular playing board has been shown, square or other shapes of boards may also be used.

I claim:

1. A board game apparatus for use in playing a game between two players, said apparatus comprising:

a game board comprising an alternating pattern of light and dark squares;

a first set of game pieces having a top surface which is light in color and a bottom surface which is dark in color;

a second set of game pieces having a top surface which is dark in color and a bottom surface which is light in color;

first keying means on each of the light squares; and second keying means on each of the dark squares, whereby said first keying means affects the appearance of the first set of game pieces but not the second set of game pieces, and said second keying means affects the appearance of the second set of game pieces but not the first set of game pieces.

2. The board game apparatus of claim 1 further comprising:

a telescoping sleeve in each game piece, wherein said first keying means causes the telescoping sleeve to extend from said first set of game pieces, and said second keying means causes the telescoping sleeve to extend from said second set of game pieces.

3. The board game apparatus of claim 2 further comprising:

a set of pegs comprising said first keying means; and a post on the bottom surface of said first set of game pieces which abuts the first keying means causing the telescoping sleeve of the first game piece to extend.

4. The board game apparatus of claim 3 further comprising:

a set of rings comprising said second keying means; and a rim on the bottom surface of said second set of game pieces which abuts the second keying means causing the telescoping sleeve of a second game piece to extend.

5. The board game apparatus of claim 4 further comprising:

an annular groove surrounding said post in said first set of game pieces, wherein the second keying means on the dark squares fit into said grooves.

6. The board game apparatus of claim 5 further comprising:

a well surrounded by the rim in said second set of game pieces, wherein the diameter of the pegs on the light square is less than the diameter of the well, and said peg fits into said well.

7. The board game apparatus of claim 6 further comprising:

a rim surrounding a well formed on the top surface on each of said first set of game pieces; and a post surrounded by a groove formed on the top surface of each of said second set of game pieces, whereby each of said first set of game pieces may be turned over to become a game piece of said second set, and each of said second set of game pieces may be turned over to become a game piece of said first set.

8. The board game apparatus of claim 1 wherein the game board comprises:

a rectangular center portion of alternating light and dark squares; and bounce zones bordering the rectangular center portion, wherien each of the four sides of the rectangular center portion has a bounce zone adjacent to it.

9. The board game apparatus of claim 8 wherein each bounce zone is one square wide and comprises a plurality of alternating light and dark squares.

10. The board game apparatus of claim 9 wherein the rectangular center portion of the game board is 6 squares wide and 7 squares long, two of the bounce zones are 6 squares long, nd two of the bounce zones are 7 squares long.

11. The board game apparatus of claim 1 wherein the game board comprises a rectangular playing area of alternating light and dark squares.

12. A board game apparatus for use in playing a game between two players, said apparatus comprising:

a playing board;

first and second sets of keying means attached to said playing board;

a plurality of game pieces;

first means on one end of each of said game pieces for changing the appearance of said game pieces in response to said first keying means;

second means on the other end of each of said game pieces for changing the appearance of said game pieces in response to said second keying means, wherein the first means on the end of said game pieces is unaffected by said second keying means, and the second means on the other end of said game pieces is unaffected by said first keying means; and a telescoping sleeve in each game piece, wherein said telescoping sleeve extends from said game pieces to change the appearance of said game pieces.

13. The board game apparatus of claim 12 further comprising:

a set of pegs comprising said first keying means; and a set of rings comprising said second keying means.

14. The board game apparatus of claim 13 further comprising:

a post on one end of each of said game pieces comprising said first means for changing; and a rim on the other end of each of said game pieces comprising said second means for changing, wherein said post has a diameter which is less than the diameter of said rings, and wherein said rim has a diameter which is greater than the said pegs.

15. A board game apparatus for use in playing a game between two players, said apparatus comprising:

a playing board;

a rectangular center portion of alternating light and dark squares and bounce zones bordering the rectangular center portion, wherein each of the four sides of the rectangular center portion has a bounce zone adjacent to its comprising the playing board;

first and second sets of keying means attached to said playing board;

a plurality of game pieces;

first means on one end of each of said game pieces for changing the appearance of said game pieces in response to said first keying means; and second means on the other end of each of said game pieces for changing the appearance of said game pieces in response to said second keying means.

16. The board game apparatus of claim 15 wherein each bounce zone is one square wide and comprises a plurality of alternating light and dark squares.

17. The board game apparatus of claim 16 wherein the rectangular center portion of the game board is 6 squares wide and 7 squares long, two of the bounce zones are 6 squares long, and two of the bounce zones are 7 squares long.

18. A board game apparatus for use in playing a game between two players, said apparatus comprising:

a playing board;

a rectangular playing area of alternating light and dark squares comprising the playing board;

first and second sets of keying means attached to said playing board;

a plurality of game pieces;

first means on one end of each of said game pieces for changing the appearance of said game pieces in response to said first keying means; and second means on the other end of each of said game pieces for changing the appearance of said game pieces in response to said second keying means.

* * * * *